US006794594B2

(12) United States Patent
Ching

(10) Patent No.: US 6,794,594 B2
(45) Date of Patent: Sep. 21, 2004

(54) POWER TOOL TRIGGER ASSEMBLY

(75) Inventor: Thomas Ka Wa Ching, Chaiwan (HK)

(73) Assignee: Defond Manufacturing Limited, Chaiwan (HK)

( * ) Notice: Subject to any disclaimer, the term of this patent is extended or adjusted under 35 U.S.C. 154(b) by 75 days.

(21) Appl. No.: 10/340,791

(22) Filed: Jan. 13, 2003

(65) Prior Publication Data

US 2004/0134766 A1 Jul. 15, 2004

(51) Int. Cl.[7] ..... H01H 13/02

(52) U.S. Cl. ..... 200/522; 200/550

(58) Field of Search ..... 200/61.71, 531, 200/61.72, 536, 547, 550, 332.2, 341, 308, 505, 314, 345, 552, 1 V

(56) References Cited

U.S. PATENT DOCUMENTS 646,269 A * 3/1900 Jong ..... 157/1.55
3,745,286 A * 7/1973 Sahrbacker ..... 200/522
6,104,105 A * 8/2000 Schaeffeler et al. ..... 307/125
6,262,380 B1 * 7/2001 Sasaki et al. ..... 200/6 BB

* cited by examiner

*Primary Examiner*—Michael Friedhofer
*Assistant Examiner*—Lisa Klaus
(74) *Attorney, Agent, or Firm*—Leydig, Voit & Mayer, Ltd.

(57) ABSTRACT

A trigger assembly for an electric power tool, comprising a base and a trigger supported by the base. The base has a housing having first and second compartments separated by a partition with an aperture. A main switch is provided in the first compartment, having first and second contacts switching on and off the motor. A slider is provided in the first compartment and is movable by or with the trigger, and includes a sliding contact. The base includes an electronic control circuit mounted on a circuit board in the second.

12 Claims, 2 Drawing Sheets

POWER TOOL TRIGGER ASSEMBLY

The present invention relates to a trigger assembly for an electric power tool.

BACKGROUND OF THE INVENTION

The operation of electric hand drills is often controlled by means of a pull trigger, which is used to switch on and off the motor as well as to adjust the motor speed/torque. A typical trigger incorporates an electrical switch for main switching and an electronic control circuit for speed control. Sparks and debris produced by the switch may foul the control circuit.

The invention seeks to mitigate or at least alleviate such a problem by providing an improved trigger assembly.

SUMMARY OF THE INVENTION

According to the invention, there is provided a trigger assembly for an electric power tool including an electric motor, comprising a base for fixing within the tool and a trigger supported by the base for inward and outward movement. The base has a housing having first and second compartments separated by a partition that includes an aperture. A main switch is provided in the first compartment, having first and second contacts co-operable to switch the motor on and off. A slider is provided in the first compartment and is movable by or with the trigger for moving the first and second contacts into contact with one another or apart, the slider including a sliding contact. The base includes an electronic control circuit mounted on a circuit board located in the second compartment for controlling the operation of the motor. The circuit board includes at least one conductive track for contact by the sliding contact through the aperture. A shield extends around the aperture and is in abutment with the circuit board for blocking debris resulting from switching action of the main switch against reaching the circuit board beyond the track.

Preferably, the shield is provided at the periphery of the aperture.

More preferably, the shield is an integral rim portion of the aperture.

It is preferred that the shield protrudes from the aperture into abutment with the circuit board.

It is preferred that the partition is an integral part of the housing.

In a preferred embodiment, the main switch and the circuit board are provided on opposite sides of the slider, and the slider includes a baffle for blocking, at least partially, rapid dispersion of sparks and debris resulting from switching action of the main switch direct across the slider.

More preferably, the baffle extends over substantially the entire dimension of the slider or the first compartment.

More preferably, the baffle comprises a rib or flange.

More preferably, the baffle is an integral part of the slider.

The invention also provides an electric power tool including an electric motor and the aforesaid trigger assembly.

As an example, the electric power tool is an electric hand drill.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
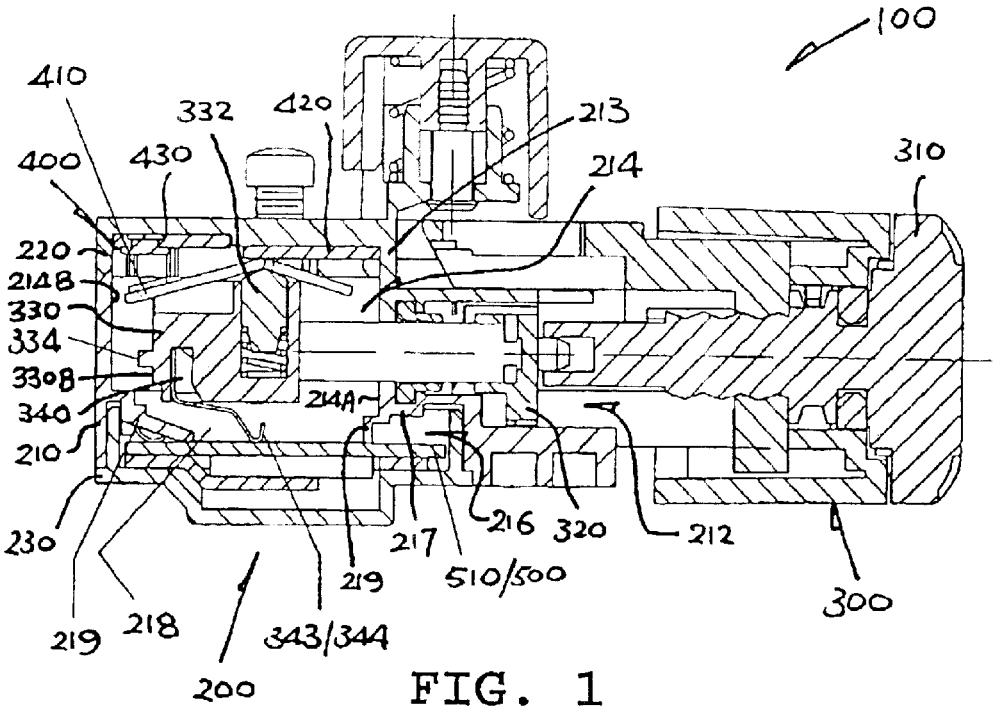
FIG. 1 is a cross-sectional top view of an embodiment of a trigger assembly in accordance with the invention.
Figure 2:
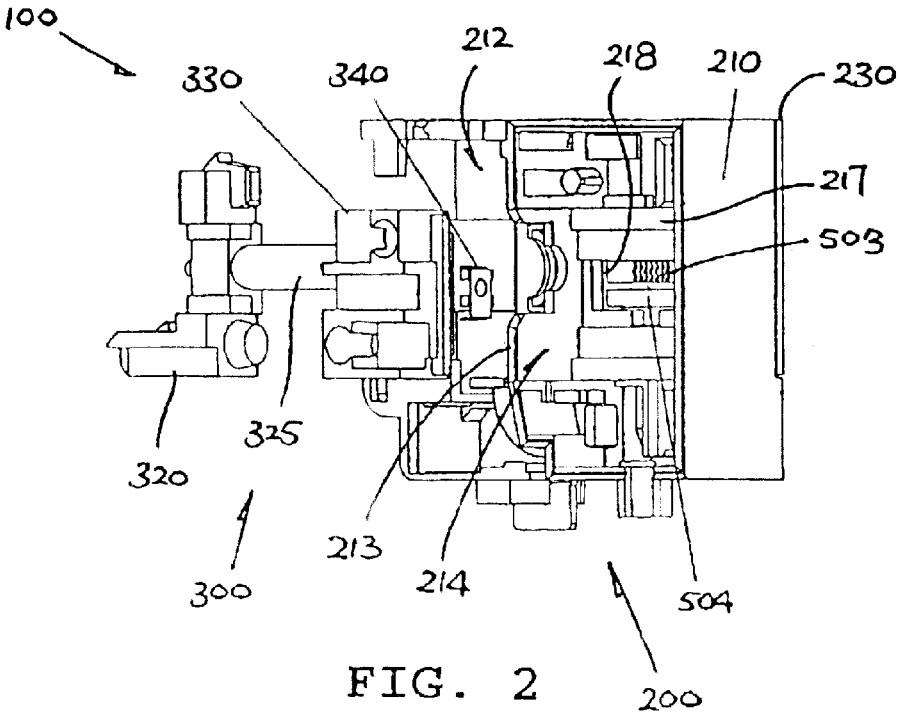
FIG. 2 is a left perspective view of part of the trigger assembly of FIG. 1.
Figure 3:
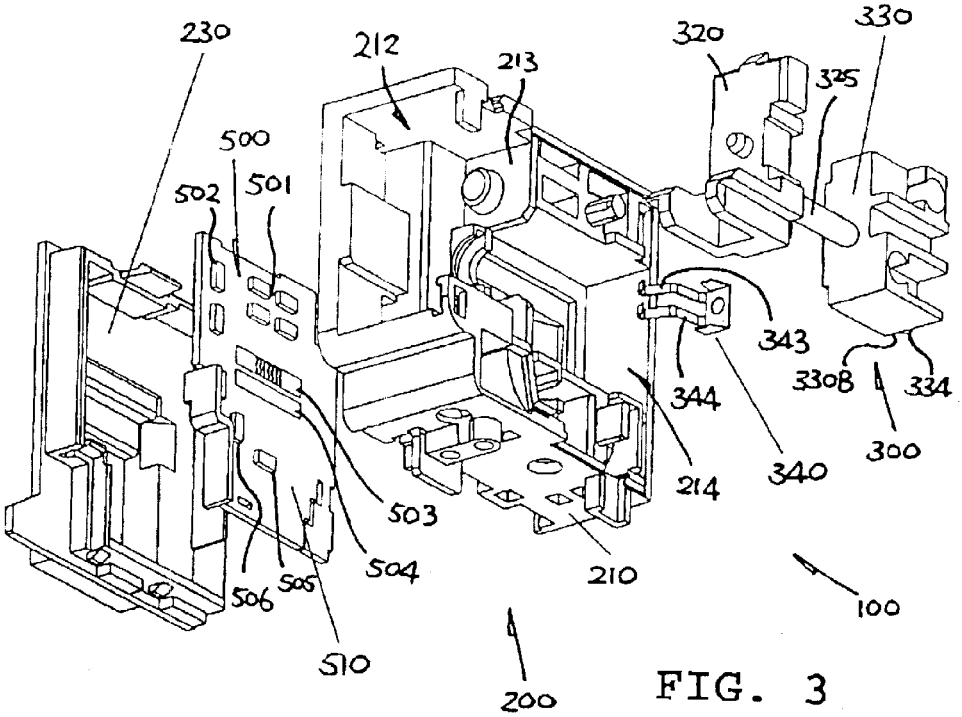
FIG. 3 is an exploded left perspective view of the part of the trigger assembly of FIG. 1.
Figure 4:
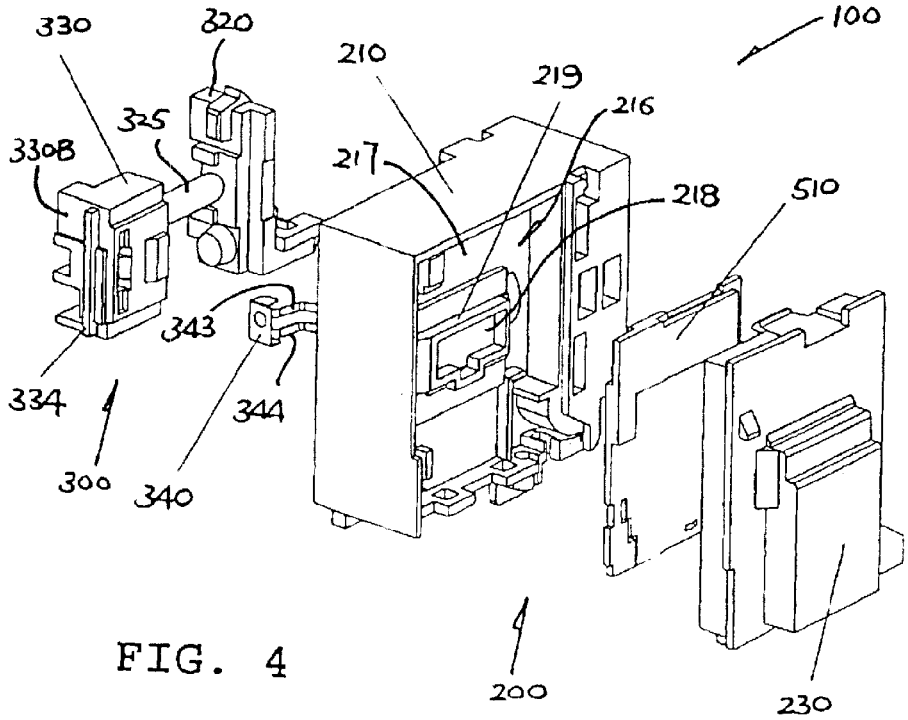
FIG. 4 is an exploded right perspective view of the part of the trigger assembly of FIG. 1.

Referring to the drawings, there is shown a trigger assembly 100 embodying the invention for controlling the operation of an electric power tool such as an electric hand drill. The trigger assembly 100 comprises a generally rectangular base 200 fixed inside the drill body adjacent its handle portion and a pull-trigger 300 supported by the base 200 for inward and outward sliding movement. A housing 210 of the base 200 has opposite left and right open sides that are closed by respective panels 220 and 230.

The housing 210 defines front and rear compartments 212 and 214 on its left side closed by the left panel 220, and a side compartment 216 on its opposite right side closed by the right panel 230. A partition wall 213 separates the front and rear compartments 212 and 214. The side compartment 216 overlaps with the entire rear compartment 214 and an adjoining part of the front compartment 212, and is separated from both by a partition wall 217. This wall 217 is formed with a rectangular slot 218 that extends longitudinally in the direction back to front, through which the rear and side compartments 214 and 216 communicate with each other.

The pull-trigger 300 has an external trigger body 310 for manual pulling, a bracket 320 behind and mounting the trigger body 310, and a core slider 330 behind the bracket 320 for switching operation. The bracket 320 and the core slider 330, which are interconnected by a horizontal shaft 325, are contained in the front and rear base compartments 212 and 214 of the base 200 respectively. The core slider 330 has a marginally smaller cross-section than the rear compartment 214. The rear compartment 214 guides the core slider 330 for forward and backward linear sliding movement, wherein the bracket 320 and hence also the trigger body 310 are slidable simultaneously therewith through support by the shaft 325. A pair of compression coil springs co-acts between the bracket 320 and the partition wall 213 between the front and rear compartments 212 and 214, thereby resiliently biassing the core slider 330 forwards and the trigger body 310 outwards.

The travel of the core slider 330 is limited by opposite front and rear ends 214A and 214B of the rear base compartment 214. The core slider 330 carries, on its left side, a pair of spring-loaded plungers 332 for operating an electrical main switch 400 and, on its right side, a sliding contact 340 having a pair of prongs 343 and 344 for control. The main switch 400 is used to switch on and off an electric motor of the hand drill. The sliding contact 340 forms part of an electronic control circuit 500 for adjusting the speed/torque of the motor based on the relative position of the core slider 330 or the trigger body 310. The control circuit 500 is mounted on a printed circuit board 510 that is attached to the inner surface of the right base panel 230 and is contained in the side base compartment 216.

The main switch 400 is formed by a pair of flat V-shaped contact levers 410 hingedly engaging a common conductive support plate 420 mounted on the inner surface of left base panel 220, and corresponding fixed contacts 430 located immediately behind the panel 220. The plungers 332 bear resiliently against respective contact levers 410 and pivot them upon sliding laterally by the core slider 330 in opposite directions. In the foremost position of the core slider 330, both contact levers 410 are pivoted off the corresponding fixed contacts 430, wherein the main switch 400 is open. Upon sliding of the core slider 330 backward from its foremost position, the two contact levers 410 are pivoted to the corresponding fixed contacts 430 one after the other, wherein the main switch 400 is closed.

The two fixed contacts 430 are located at the rear end 214B of the rear base compartment 214, where switching action of the main switch 400 will take place within the compartment 214. Although this is not clearly shown, the fixed contacts 430 include respective remote ends that extend through opposite corners of the housing 210 into the side base compartment 216, where they are in press contact with respective contact pads on the control circuit board 510.

The main switch 400 is for switching on and off a highly inductive load, i.e. the motor of the hand drill, whose operating current is often large and may surge up to 10A at startup. Thus, sparks and hence debris will inevitably be produced as a result of such a heavy inductive current switching action, including carbon/hydrocarbon dust and particles and residue/burn-off from grease and oil. Such switching debris will in the course of time foul the control circuit 500, if permitted to reach the circuit 500.

The switching action of the main switch 400 will take place on the left side of the core slider 330, from where the switching debris will be produced. A barrier or baffle, such as a flange or rib 334, is formed integrally on a rear end 330B of the core slider 330, as an extension thereof. The baffle rib 334 extends over substantially the entire dimension, i.e. height as shown, of the core slider 330 and hence that of the rear base compartment 214. It serves to narrow the horizontal gap between the slider end 330B and the adjacent compartment end 214B, thereby blocking, at least partially, rapid dispersion of the switching sparks and debris direct across the core slider 330 to the opposite right side thereof, where the circuit board 510 is located.

The control circuit 500 incorporates an output selector for adjusting the speed/torque of the drill motor, which includes a series of resistors 501 and a capacitor 502. The ends/junctions of the resistors 501 are connected to a row of respective contact pads/strips arranged on the circuit board 510 as a first conductive track 503. A second, one-piece conductive track 504 extends close alongside the first track 503, to which the capacitor 502 is connected. The relative charging and discharging periods of the capacitor 502 are controllable by changing the connection of the resistors 501 to the capacitor 502 upon operation of the output selector, thereby resulting in an oscillating control signal having a variable duty cycle.

Upon receipt of the control signal, an integrated circuit 505 of the control circuit 500 generates a trigger signal for a solid-state switch 506, which is connected in series with the main switch 400 to control the current driving the drill motor. Thus, the speed/torque of the motor are adjustable based on the duty cycle of the control signal.

The two conductive tracks 503 and 504 are aligned with the slot 218 of the base partition wall 217 and are accessible through the slot 218 by the prongs 343 and 344 of the sliding contact 340. The contact prongs 343 and 344 extend through the slot 218 and bear resiliently against the tracks 503 and 504 respectively. Upon sliding of the core slider 330, the second prong 344 remains in uninterrupted contact with the second track 504 and thus connected continuously to the capacitor 502. On the other hand, the first prong 343 comes into contact with different segments (pads/strips) of the first track 503, thereby changing the connection of the resistors 501 to the capacitor 502 and in turn the operation of the drill motor.

The slot 218 is just sufficiently large for the sliding contact prongs 343 and 344 to pass through the base partition wall 217, thereby minimizing the area of the control circuit board 510 exposed to the rear base compartment 214, from where the switching sparks and debris are produced. In addition, the slot 218 has an integral rim portion 219 that extends around the complete periphery of the slot 218 and protrudes towards and bears against or is in abutment with the control circuit board 510 around the conductive tracks 503 and 504. The rim portion 219 acts as a shield sealing the gap between the circuit board 510 and the base partition wall 217. The shield 219 serves to block the switching debris against reaching or spreading onto the circuit board 510 beyond the tracks 503 and 504, thereby protecting the other circuit elements 501, 502, 505 and 506 from contamination.

It is envisaged that the subject trigger assembly may be utilized to control any other types of electric power tools, such as a reamer, cutter or saw.

The invention has been given by way of example only, and various modifications of and/or alterations to the described embodiment may be made by persons skilled in the art without departing from the scope of the invention as specified in the appended claims.

What is claimed is:

1. A trigger assembly for an electric power tool including an electric motor, comprising:

a base for fixing within said tool; and a trigger supported by the base for inward and outward movement;

wherein the base comprises:

a housing having first and second compartments separated by a partition that includes an aperture;

a main switch provided in the first compartment and having first and second contacts co-operable to switch said motor on and off;

a slider provided in the first compartment and movable by or with the trigger for moving the first and second contacts into contact with one another or apart from one another, the slider including a sliding contact;

an electronic control circuit mounted on a circuit board located in the second compartment for controlling the operation of said motor, the circuit board including at least one conductive track for contact by the sliding contact through the aperture; and a shield extending around the aperture and in abutment with the circuit board for blocking debris resulting from the switching action of the main switch against reaching the circuit board beyond the track.

2. The trigger assembly as claimed in claim 1, wherein the shield is provided at the periphery of the aperture.

3. The trigger assembly as claimed in claim 2, wherein the shield is an integral rim portion of the aperture.

4. The trigger assembly as claimed in claim 1, wherein the shield protrudes from the aperture into abutment with the circuit board.

5. The trigger assembly as claimed in claim 1, wherein the partition is an integral part of the housing.

6. The trigger assembly as claimed in claim 1, wherein the main switch and the circuit board are provided on opposite sides of the slider, and the slider includes a baffle for blocking, at least partially, the dispersion of sparks and debris resulting from the switching action of the main switch across the slider.

7. The trigger assembly as claimed in claim 6, wherein the baffle extends over substantially the entire dimension of the slider.

8. The trigger assembly as claimed in claim 6, wherein the baffle comprises a rib or flange.

9. The trigger assembly as claimed in claim 6, wherein the baffle is an integral part of the slider.

10. The trigger assembly as claimed in claim 6, wherein the baffle extends over substantially the entire dimension of the first compartment.

11. An electric power tool including an electric motor and the trigger assembly as claimed in claim 1.

12. The electric power tool as claimed in 11, being an electric hand drill.

* * * * *